US011572686B2

(12) United States Patent
Espinosa et al.

(10) Patent No.: US 11,572,686 B2
(45) Date of Patent: Feb. 7, 2023

(54) BUILDING WITH ROOF TRUSSES DIRECTLY CONNECTED TO THE FOUNDATION

(71) Applicant: CETRES HOLDINGS, LLC, Jackson, WY (US)

(72) Inventors: Thomas M. Espinosa, Snohomish, WA (US); Anthony J. Masolini, Scottsdale, AZ (US)

(73) Assignee: CETRES HOLDINGS, LLC, Jackson, WY (US)

( * ) Notice: Subject to any disclaimer, the term of this patent is extended or adjusted under 35 U.S.C. 154(b) by 173 days.

(21) Appl. No.: 16/433,425

(22) Filed: Jun. 6, 2019

(65) Prior Publication Data

US 2019/0376274 A1 Dec. 12, 2019

Related U.S. Application Data

(62) Division of application No. 13/343,429, filed on Jan. 4, 2012, now Pat. No. 10,526,780.

(60) Provisional application No. 61/429,719, filed on Jan. 4, 2011.

(51) Int. Cl.

| | |
|---|---|
| ***E04B 1/26*** | (2006.01) |
| ***E04C 3/16*** | (2006.01) |
| ***E04C 3/08*** | (2006.01) |
| ***E04C 3/292*** | (2006.01) |
| *E04B 1/35* | (2006.01) |

(52) U.S. Cl.

CPC ..... *E04B 1/26* (2013.01); *E04C 3/08* (2013.01); *E04C 3/16* (2013.01); *E04C 3/292* (2013.01); *E04B 2001/2688* (2013.01); *E04B 2001/3583* (2013.01)

(58) Field of Classification Search

CPC ..... E04B 2001/2688; E04B 2001/3583; E04B 2001/2684; E04B 2001/268; E04B 2001/2696; E04B 2001/2644; E04B 2002/0254; E04B 1/26; E04C 3/018; E04C 3/292; E04C 3/16

See application file for complete search history.

(56) References Cited

U.S. PATENT DOCUMENTS

| | | | | |
|---|---|---|---|---|
| 1,375,402 A ‡ | 4/1921 | Frederick et al. | ..... | E04B 1/10 52/91 |
| 3,000,145 A * | 9/1961 | Fine | ..... | E04B 1/41 52/699 |
| 3,330,084 A * | 7/1967 | Russell | ..... | E04B 2/7809 52/300 |
| 4,457,118 A ‡ | 7/1984 | Bowen | ..... | E04B 1/0007 52/292 |

(Continued)

*Primary Examiner* — Jessica L Laux

(74) *Attorney, Agent, or Firm* — Shlesinger, Arkwright & Garvey LLP

(57) ABSTRACT

The present invention provides a building comprising a foundation; a wall supported by the foundation; and trusses supported by the wall. A plurality of hold down assemblies connects at least some of the trusses directly to the foundation. Each hold down assembly comprises an anchor; a tie-rod connected to the anchor; a bearing plate operably associated with an end portion of an associated truss for transferring load to the tie-rod; and a fastener securing the tie-rod to the bearing plate, thereby tying the associated truss directly to the foundation.

8 Claims, 18 Drawing Sheets

(56) References Cited

U.S. PATENT DOCUMENTS 4,525,972 A ‡ 7/1985 Palacio et al. ..... E04C 3/292 403/23
4,812,096 A ‡ 3/1989 Peterson ..... F16B 31/04 29/446
4,875,314 A ‡ 10/1989 Boilen ..... E04B 1/06 52/167
5,303,520 A * 4/1994 Gozdziak ..... E04B 7/04 403/59
5,335,470 A * 8/1994 Alvarez ..... E04B 1/4107 249/213
5,357,721 A * 10/1994 Alvarez ..... E04B 1/4107 52/272
5,384,993 A * 1/1995 Phillips ..... E04B 1/34347 52/223.6
5,448,861 A 9/1995 Lawson
5,531,054 A 7/1996 Ramirez
5,535,561 A 7/1996 Schuyler
5,537,786 A 7/1996 Lozier et al.
5,761,863 A ‡ 6/1998 Sutt et al. ..... E04B 7/04 52/272
6,161,350 A ‡ 12/2000 Espinosa ..... E04H 9/02 52/293
6,367,205 B2 4/2002 Cornett, Sr.
6,390,747 B1 ‡ 5/2002 Commins ..... F16B 5/0233 411/23
6,553,736 B2 ‡ 4/2003 Montanaro et al. ..... E04C 3/07 52/34
6,930,747 B2 8/2005 Lee
7,621,085 B2 ‡ 11/2009 Commins ..... E04B 1/2604 411/53
7,762,030 B2 ‡ 7/2010 Espinosa ..... E02D 27/34 52/293
8,112,955 B2 2/2012 Espinosa
8,136,318 B2 3/2012 Espinosa
2002/0010026 A1 8/2002 Huppert
2003/0136075 A1 ‡ 7/2003 Brackett ..... E04B 1/26 52/712
2003/0182875 A1 10/2003 Hill
2004/0118053 A1 6/2004 Huppert
2005/0193681 A1 ‡ 9/2005 Brackett ..... E04H 9/028 52/698
2009/0307988 A1 12/2009 Hamlin, III
2010/0180540 A1 ‡ 7/2010 Shepard ..... E04B 1/26 52/745
2011/0072732 A1 ‡ 3/2011 Schilling ..... E04H 9/14 52/23

* cited by examiner
‡ imported from a related application

BUILDING WITH ROOF TRUSSES DIRECTLY CONNECTED TO THE FOUNDATION

RELATED APPLICATION

This is a nonprovisional application of provisional application Ser. No. 61/429,719, filed on Jan. 4, 2011, the priority benefit of which is hereby claimed.

FIELD OF THE INVENTION

The present invention is directed to a building where the roof trusses and the floor trusses below are directly connected to the foundation.

SUMMARY OF THE INVENTION

The present invention provides a building comprising a foundation; a wall supported by the foundation; and trusses supported by the wall. A plurality of hold down assemblies connects at least some of the trusses directly to the foundation. Each hold down assembly comprises an anchor; a tie-rod connected to the anchor; a bearing plate operably associated with an end portion of an associated truss for transferring load to the tie-rod; and a fastener securing the tie-rod to the bearing plate, thereby tying the associated roof truss directly to the foundation.

The roof truss may be a pin connected type truss having a top cord and a bottom chord. An end portion of the top chord or the bottom chord is connected to the end portion of the tie-rod. The wall may include a ledger on which the roof trusses are supported. The wall may also include a bridge member supported by opposite blockings or nailers attached to the respective studs. The bridge member may wood, solid metal or hollow metal. The roof truss may also be supported on the top plate of the wall.

The bearing plate may be solid metal or hollow metal. The fastener may be an expanding fastener adapted to take up any slack in the tie-rod. The expanding fastener includes a spring under compression disposed between the bearing plate and a nut. The fastener may also be a nut pressing directly against the bearing plate.

The present invention further provides a building, comprising a foundation; a wall supported by the foundation; roof trusses supported by the wall; and a plurality of hold down assemblies connecting at least some of the roof trusses directly to the foundation. Each hold down assembly comprising a concrete anchor; an anchor rod connected to the anchor; a tie-rod connected to the anchor rod; a hanger having opposed side walls and a bottom wall; a bearing plate supported by the bottom wall; and a fastener securing an end portion of the tie-rod to the bearing plate; the side walls being operably attached to an end portion of an associated roof truss; and the fastener being attached to the tie-rod extending through an opening in the bottom wall and the bearing plate, thereby tying the associated roof truss directly to the foundation.

Other features and advantages of the present invention will be readily apparent from the following detailed description taken in connection with the accompanying drawings.

DETAILED DESCRIPTION OF THE INVENTION

Figure 1:
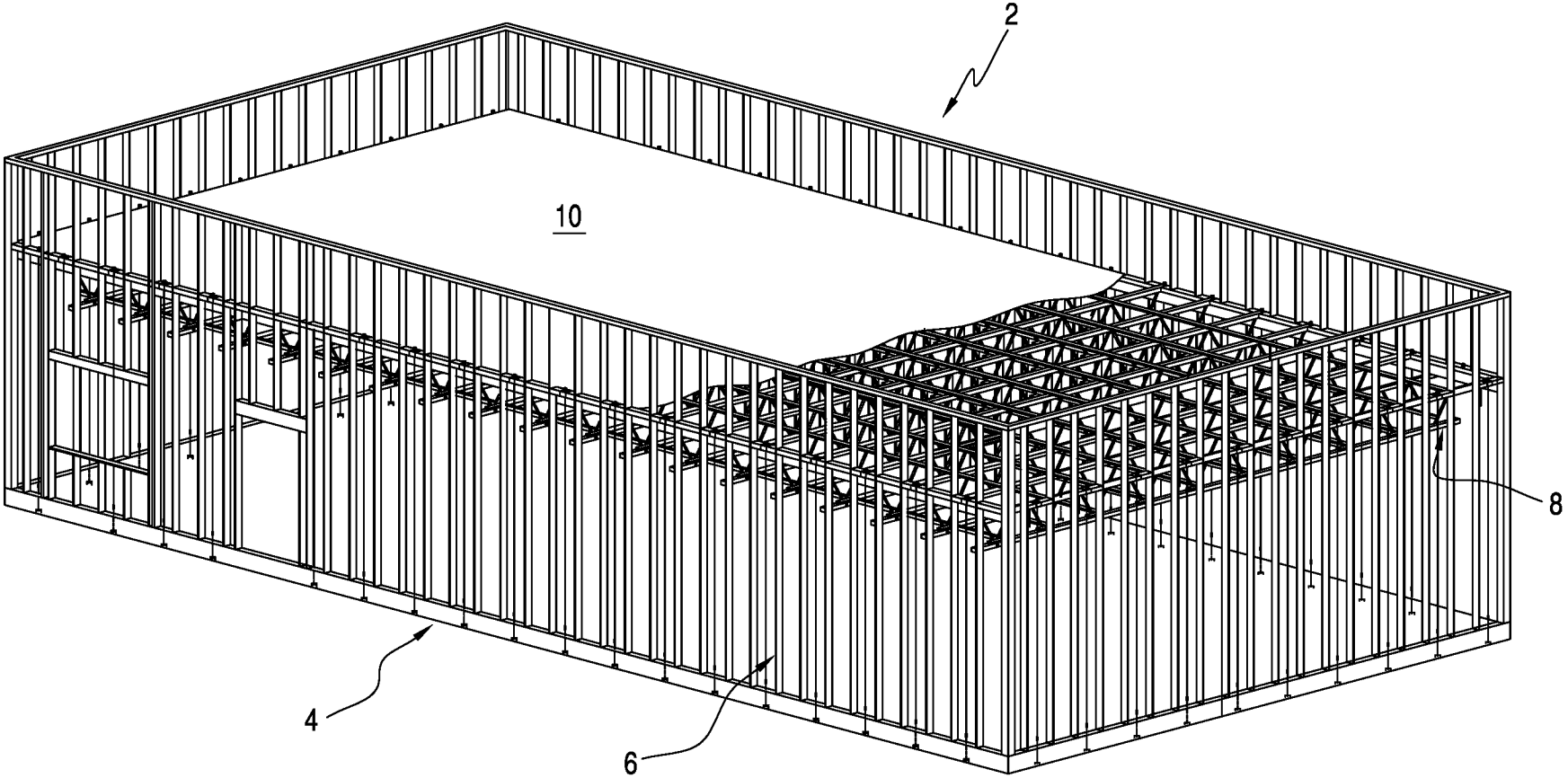
FIG. 1 is a perspective view of a building structure, showing a wall structure supported on a foundation and roof trusses supported by the wall structure.

A building 2 embodying the present invention is disclosed in FIG. 1. The building 2 includes a concrete foundation 4, supporting an outside wall structure 6. The wall structure 6 supports a plurality of roof trusses 8 that support a roof sheathing 10. Although the building 2 disclosed herein uses wood framing members, it should be understood to a person skilled in the art that the present invention will also be applicable to steel framing construction.

The term foundation is used here in a general sense. It is used to refer generally to any structure that is used to anchor or tie a building to the ground. Examples are concrete foundation walls, concrete slabs, horizontal concrete, steel or wood beams connected to vertical concrete, steel or wood beams driven or buried in the ground, or any substantial structure solidly anchored in the ground. Accordingly, a building foundation can be any structure that is capable of transferring the load of the building to the ground.

Figure 2:
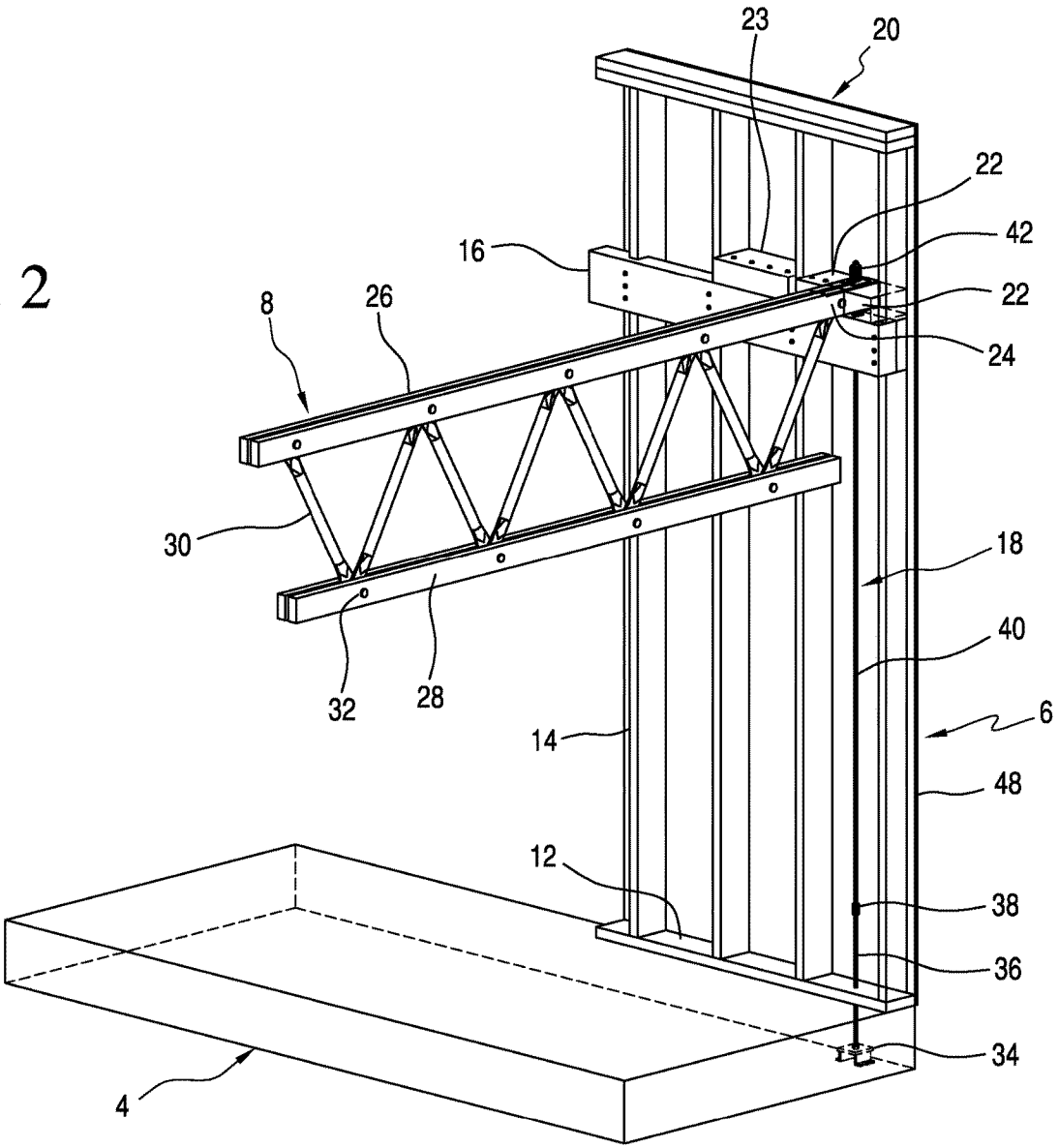
FIG. 2 is an enlarged perspective view of a portion of the building structure of FIG. 1, showing details on roof truss and wall structure connection and a hold down assembly tying the roof truss directly to the foundation.

Referring to FIG. 2, the wall structure 6 comprises a base plate 12, vertical studs 14, a horizontal ledger 16, a hold down assembly 18 and top plates 20. The trusses 8 are supported on the ledger 16. Blockings 22 sandwich an end portion 24 of the respective truss 8 and fill the space between the respective studs 14. Another blocking 23 may be used in the next ledger space between the next two studs for additional rigidity to the wall structure. The hold down assembly 18 is preferably disposed within the volume of the wall structure 6.

The truss 8 is a pin-connected truss, comprising a top chord 26, a bottom chord 28, a plurality of metal webs 30 connecting the top chords 26 to the bottom chords 28 by pins 32.

Figure 3:
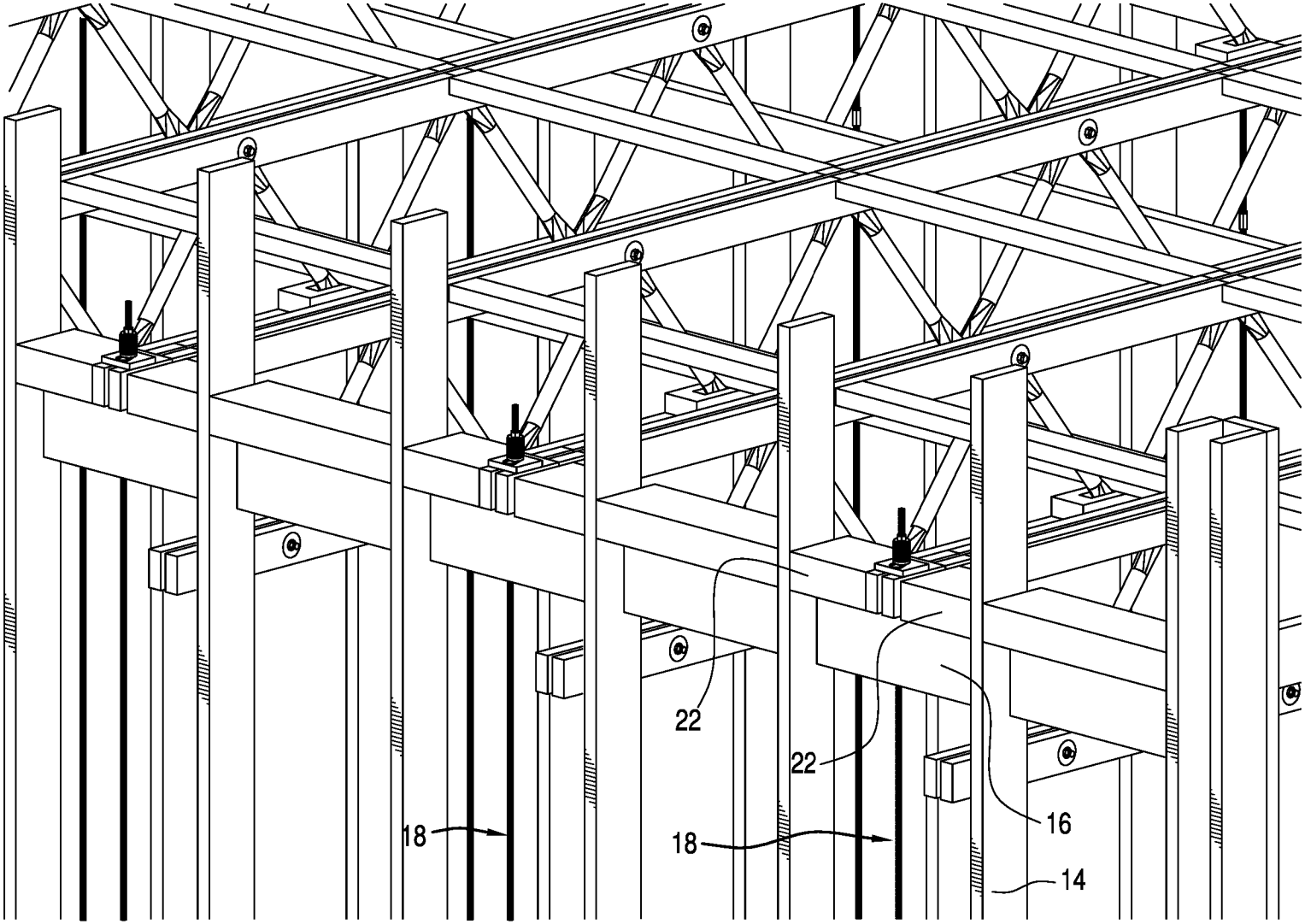
FIG. 3 is an enlarged perspective view of a portion of the building structure of FIG. 1, showing the hold down assembly tying each one of the roof trusses to the foundation.

The hold down assembly 18 comprises a concrete anchor 34 including an anchor rod 36, a coupling 38 connecting the anchor rod 36 to a tie-down rod 40, and a fastener 42 connecting an end portion of the tie-rod 40 to the top chord 26 of the truss 8. The hold down assembly 18 is shown attached to every roof truss 8, as shown in FIGS. 1 and 3, although a lesser number of roof trusses 8 may be thus secured, depending on the uplift load generated by winds, storms, earthquake, etc. expected in the building location. For example, every other roof truss may be secured by the hold down assembly 18. The tie-rod 40 may connect directly to the anchor 34, in which case the anchor rod 36 is not used.

Concrete anchors are well known in the art. The concrete anchor 34 disclosed is exemplary. It is shown embedded in the foundation 4, which is in the form of a concrete slab.

Figure 4:
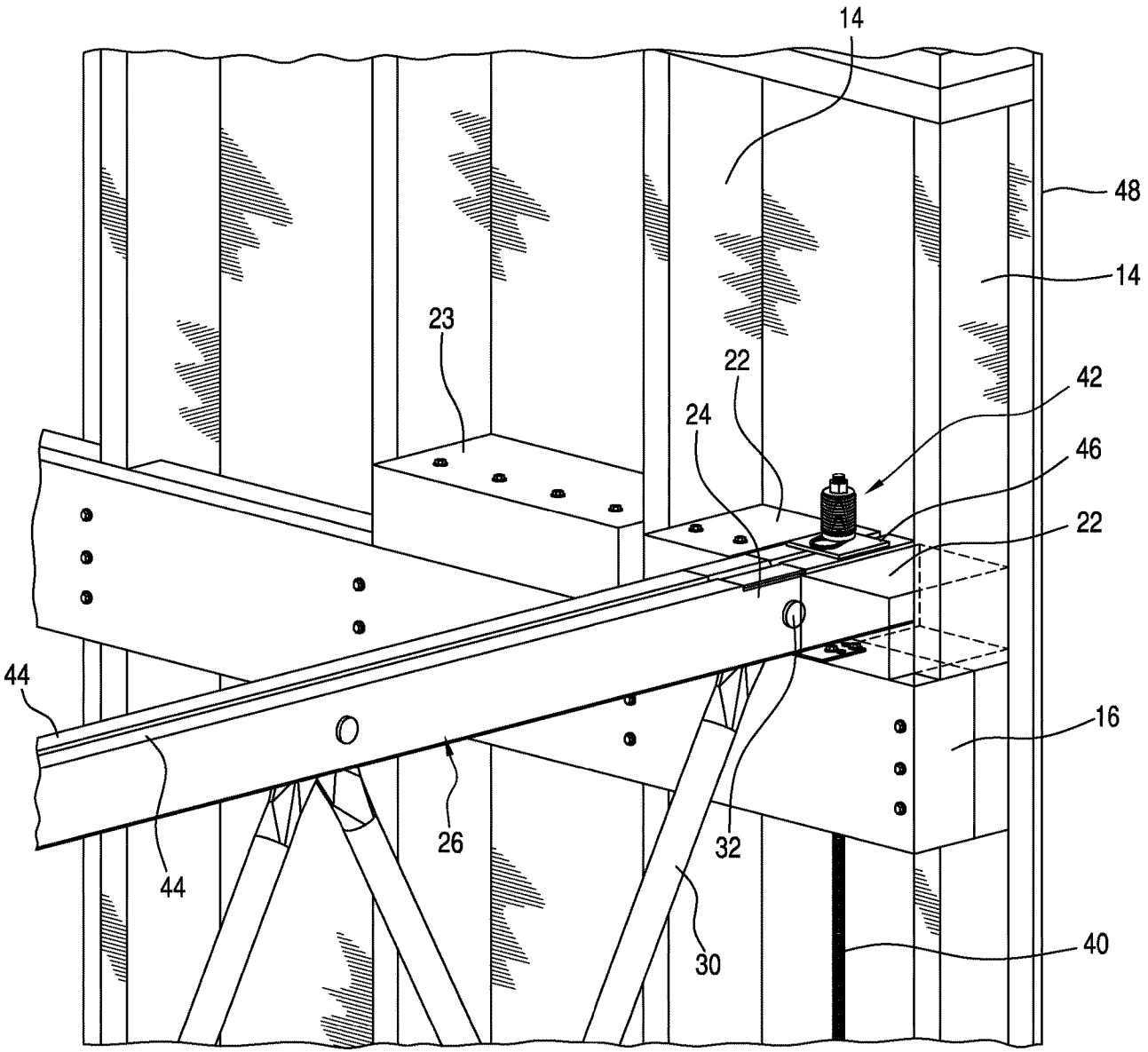
FIG. 4 is an enlarged perspective view of the connection of the roof truss to the wall, showing the roof truss being supported on a ledger attached to the wall structure.

Referring to FIG. 4, the top chord 26 is made of two members 44, sandwiching the end portions of the webs 30. The end portion of the tie-rod 40 extends through between the two members 44. A bearing plate 46 is operably associated with the end portion 24 of the top chord 26 to transfer load from the truss 8 to the tie-rod 40. The bearing plate 46 is disposed between the fastener 42 and the end portion 24 of the top chord 26. The bearing plate 46 rests on a top horizontal top surface of the top chord 26. The end portion of the tie-rod 40 is disposed between a wall sheathing 48 and the ledger 16. The ledger 16 is advantageously recessed into the studs 14 for greater support and is attached with standard fasteners such as nails, screws, bolts, etc. The blockings 22 advantageously provide lateral support to the end portion 24 of the truss 26.

Figure 5:
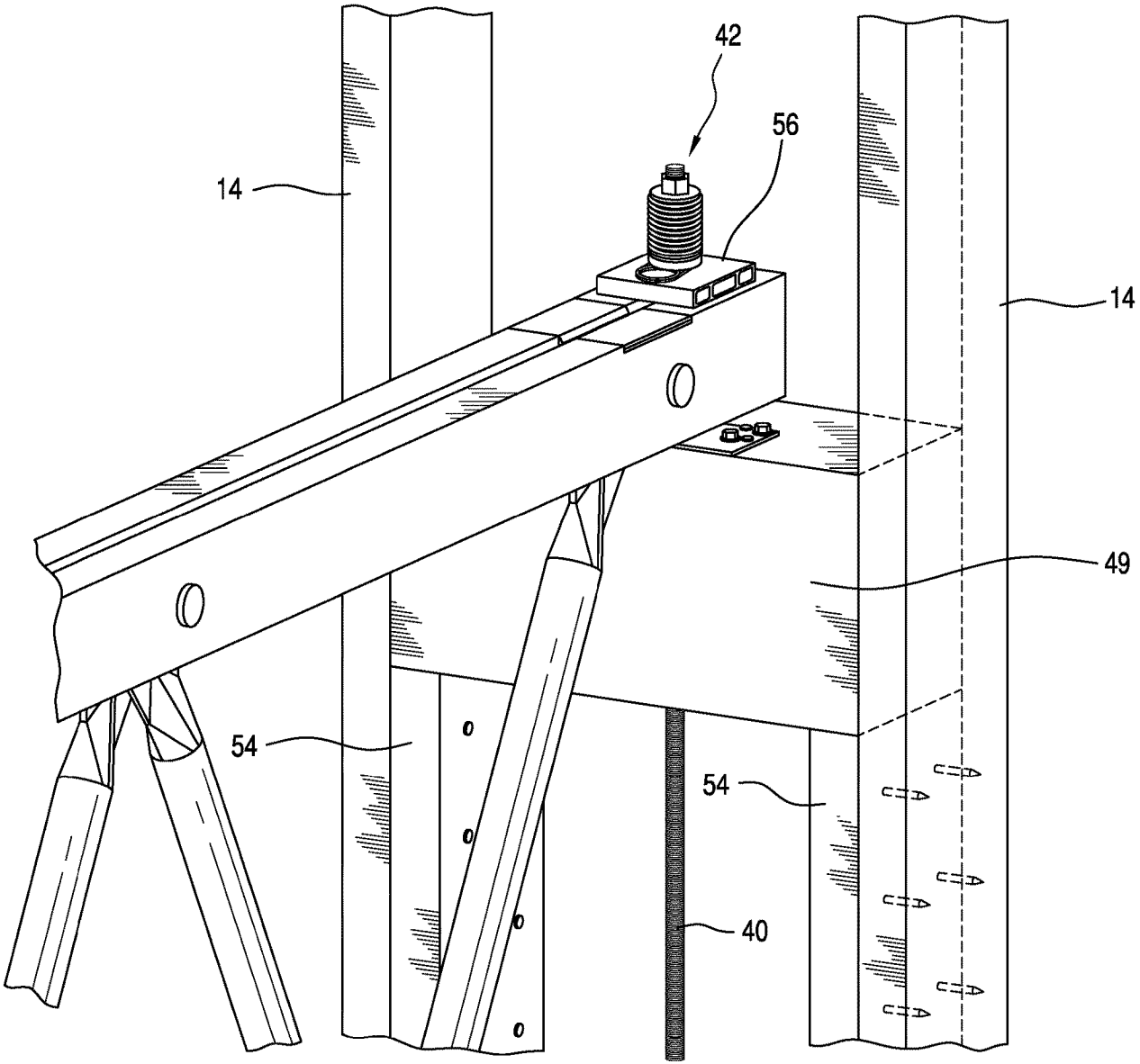
FIGS. 5-7 are enlarged perspective views of the connection of the roof truss to the wall, showing the roof truss being supported on a wood bridge member (FIG. 5), a solid member bridge (FIG. 6) and a hollow metal bridge (FIG. 7) attached to the wall structure.
Figure 6:
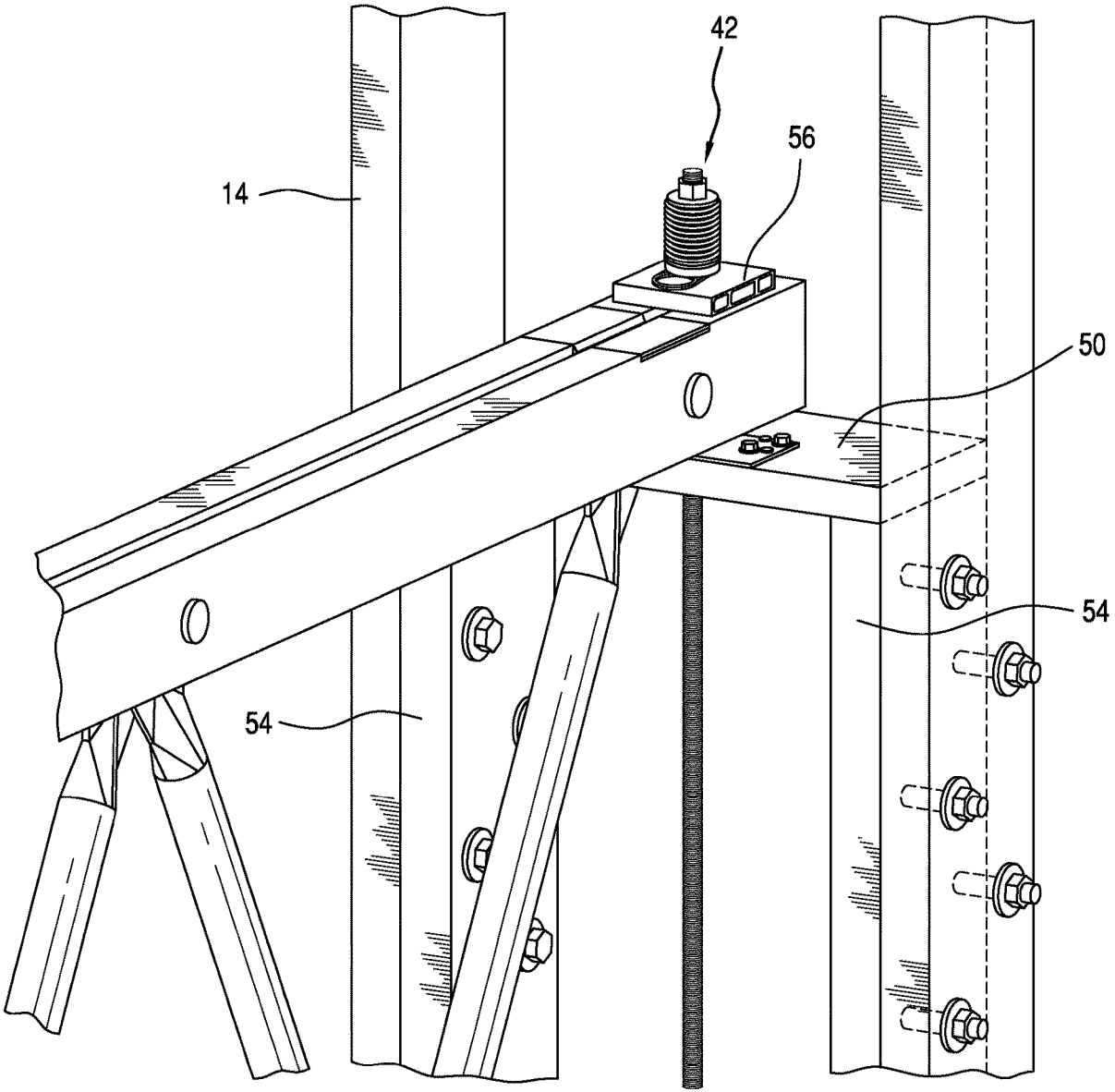
Figure 7:
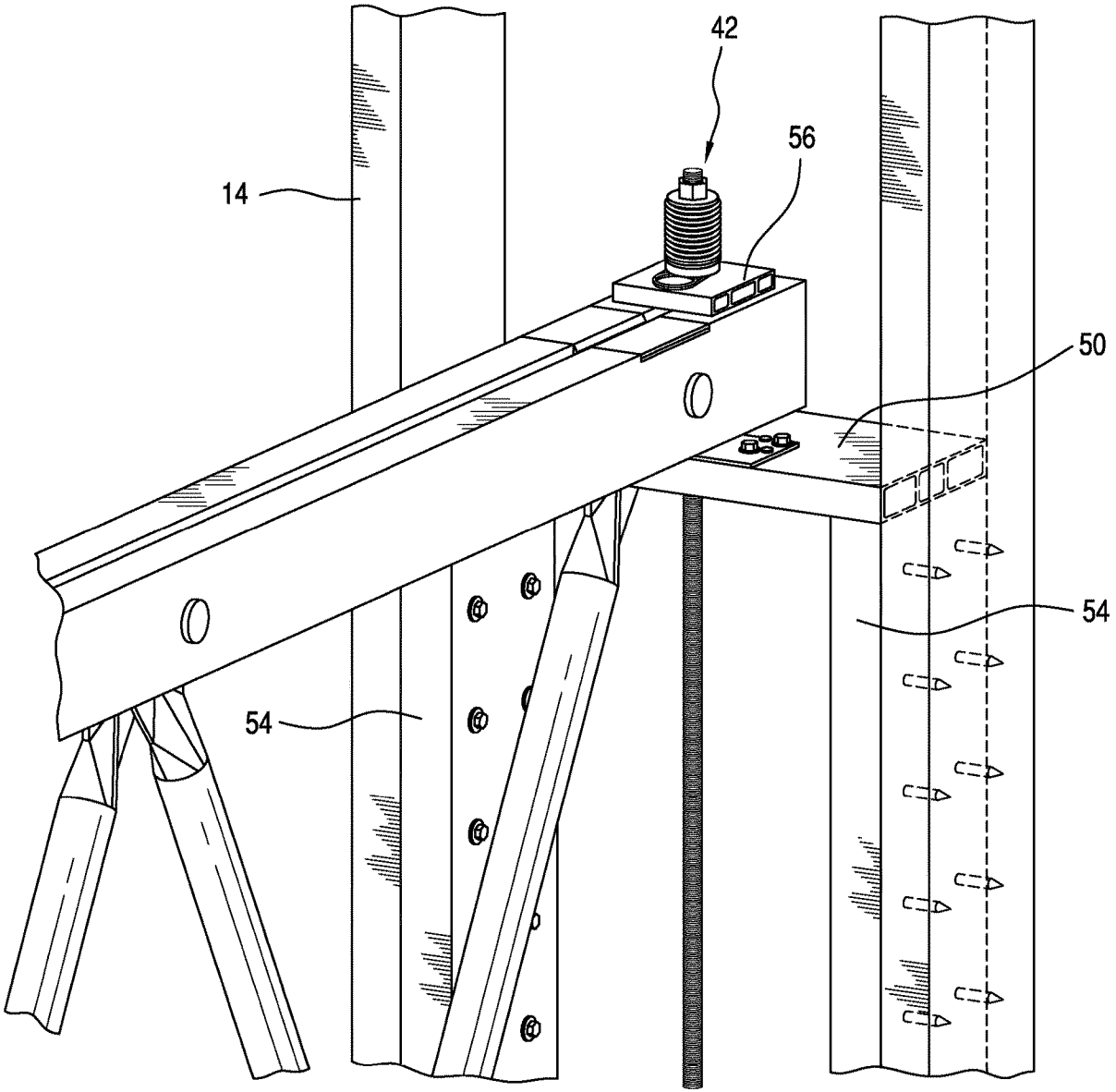

Referring to FIGS. 5, 6 and 7, the ledger 16 may be replaced with a wood bridge member 49, a solid metal bridge member 50 (FIG. 6), or a hollow metal bridge member 52 (FIG. 7) supported by blocking members or nailers 54 attached with standard fasteners such as nails, screws, bolts, etc. to the respective studs 14. The blocking members 54 are preferably short pieces of stud lumber. The blocking members 54 may also extend to the base plate 12 for greater load capacity. An example of the bridge member 52 is disclosed in co-pending application Ser. No. 12/588,101 ('101 application), incorporated herein by reference. In the embodiment shown in FIGS. 5-7, the end of the tie-rod 40 extends through an opening in the bridge member 49, 50 or 52. The bearing plate 46 may be solid metal or hollow metal plate 56, for example, as disclosed in the '101 application.

Figure 8:
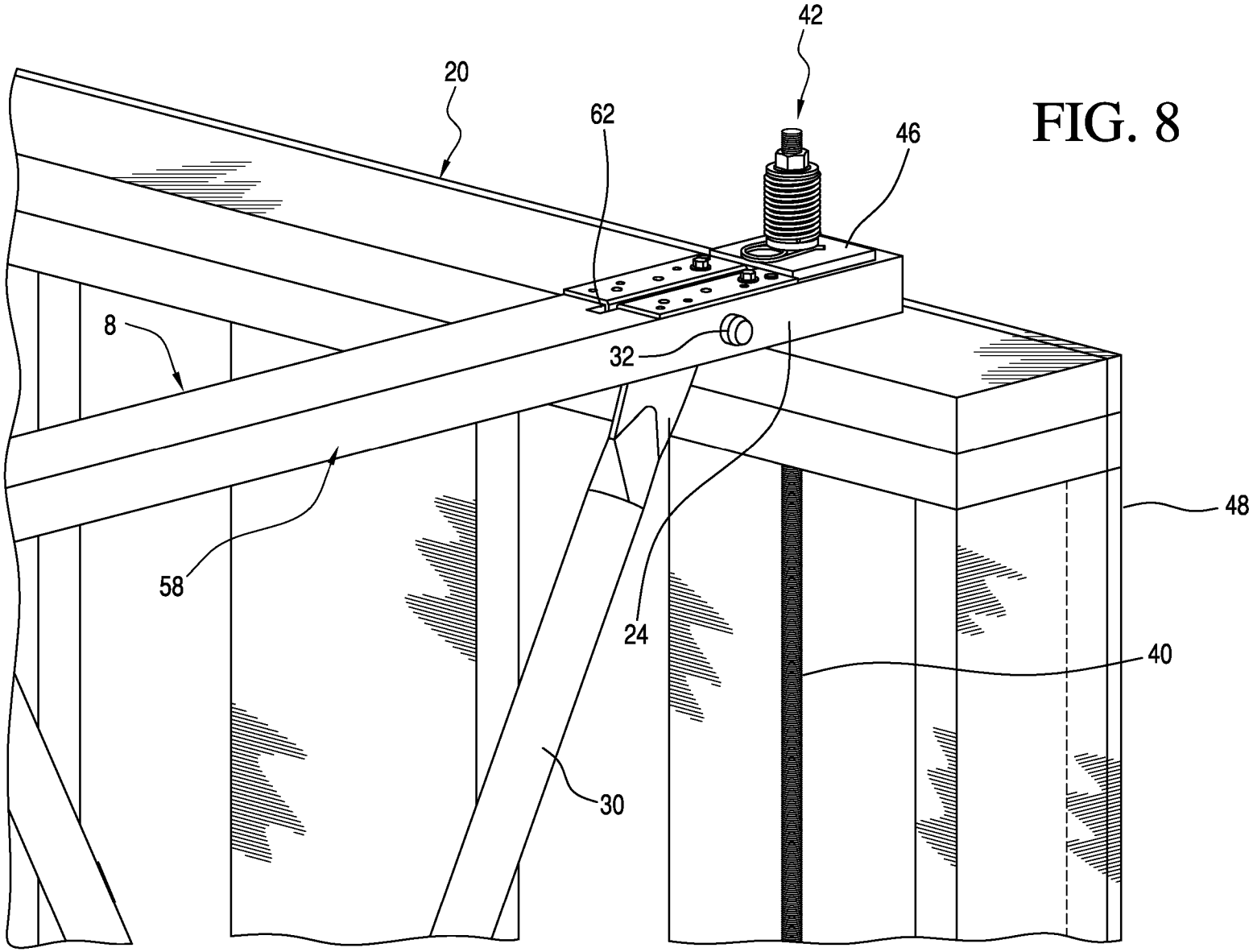
FIG. 8 is an enlarged perspective view of the connection of the roof truss to the wall, showing the roof truss being supported on a top plate of the wall structure.

Referring to FIG. 8, the end portion 24 of the truss 26 is supported on the top plate 20. The end portion of the tie-rod 40 extends through an opening in the top plate 20 and the end portion 24. The fastener 42 bears on the solid metal bearing plate 46, which may also be replaced with the hollow metal bearing plate 56. The truss 8 is of the type having a single member top chord 58 and a single-member bottom chord 60 (shown in FIG. 11) with a slot 62 which receives the end portion of the web 30 and connected by the pin 32. The truss 8 may also be of the type having the double-member top chord 26 and double-member bottom chord 28, as shown in FIG. 4, for example.

Figure 9:
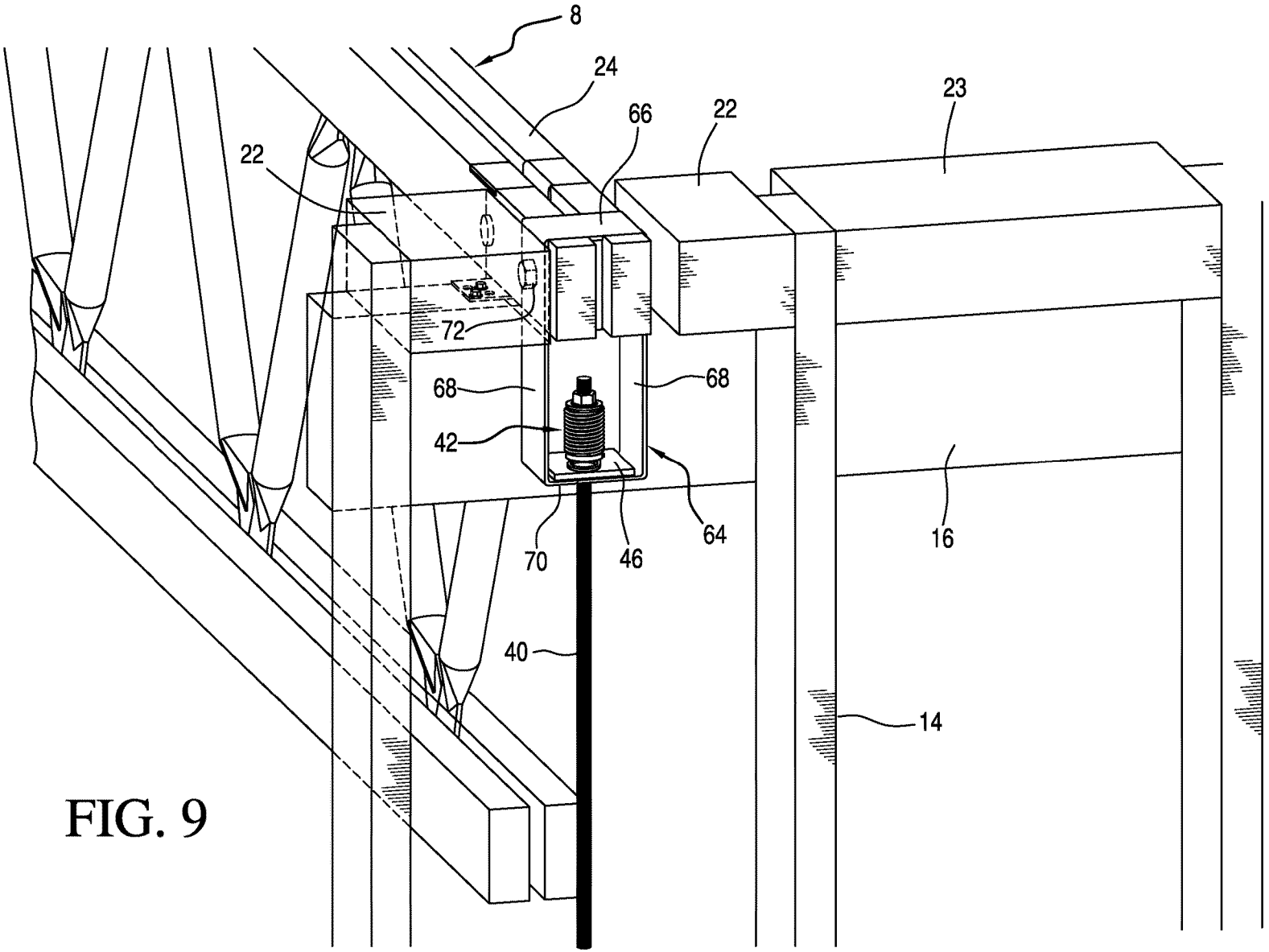
FIG. 9 is an enlarged perspective view of the connection of the roof truss to the wall, showing the roof truss being supported on a ledger attached to the wall and the tie-rod of the hold down assembly being tied to a hanger bracket attached to the end portion of the top chord of the roof truss.
Figure 17:
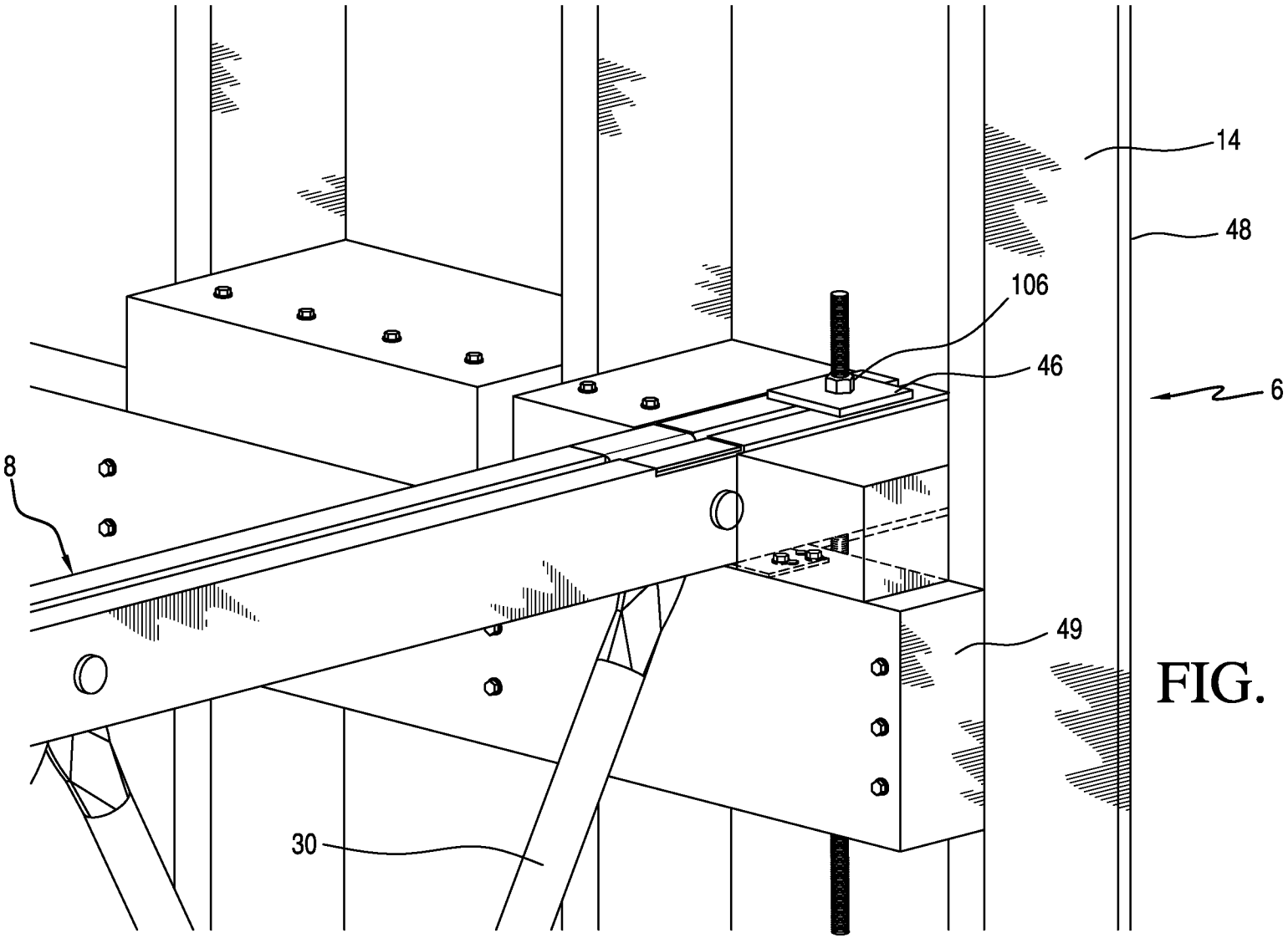
FIG. 17 is an enlarged perspective view of the connection of the tie-rod to the roof truss using a nut pressing on a bearing plate.

Referring to FIG. 9, a metal hanger 64 with a top wall 66, side walls 68 and a bottom wall 70 is used to attach the end portion 24 of the truss 8 to the ledger 16. The top wall 66 engages the top surface of the end portion 24. A bolt 72 attaches the side walls 68 to the end portion 24 through the thickness of the truss 8. The end portion of the tie-rod 40 extends through an opening in the bottom wall 70 and is secured with the fastener 42. The bearing plate 46 is disposed between the bottom wall 70 and the fastener 42. In this embodiment, the top surface of the end portion 24 of the truss 8 is clear of any substantial projections so that roof sheathing may be installed on top of the top wall 66. The ledger 16 is shown butt jointed to the edges of the studs 14, but may also be recessed into the studs 14. The end portion 24 extends beyond the ledger 16 to allow the hanger 64 to attach to the truss end portion and be confined within the depth or space of the stud wall. The bearing plate 46 is substantially the width of the bottom wall 70 to advantageously transmit the downward holding force exerted by the tie-rod 40 directly to the side walls 68 and minimize deformation of the hanger 64, which deformation may loosen and thereby affect the effectiveness of the hold down assembly 18. The embodiment shown in FIG. 9 may be used for sloping roofs. The fastener 42 may be a simple nut, as shown in FIG. 17.

Figure 18:
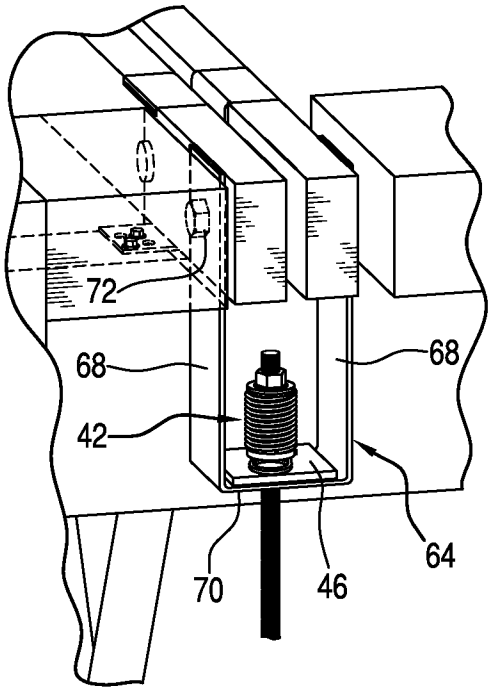
FIG. 18 is a perspective view of another embodiment of a hanger used in the present invention.

The hanger 64 may be modified wherein the top wall 66 is eliminated, as shown in FIG. 18, leaving a U-shaped hanger having the side walls 68 and the bottom wall 70. The bolt 72 operably attaches the side walls to truss end portion.

Figure 19:
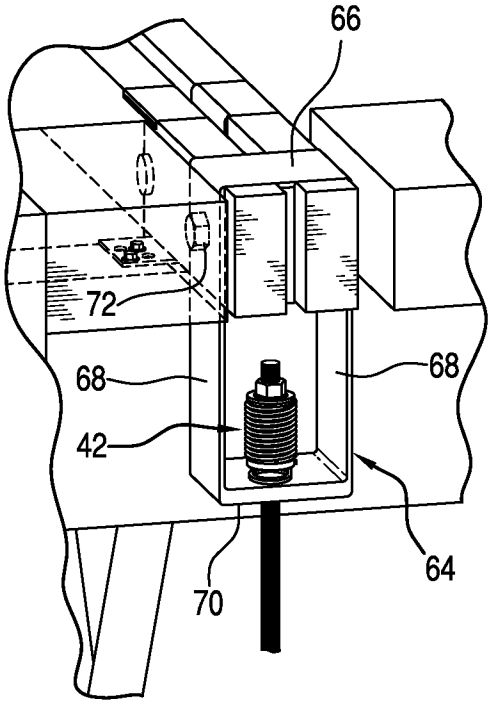
FIG. 19 is a perspective view of yet another embodiment of a hanger used in the present invention.

The hanger 64 may be further modified, as shown in FIG. 19, wherein the bottom wall 70 and the base plate 46 are integrated into one unit by using a thicker gauge steel, for example. In this embodiment, the function of the bearing plate 46 is provided by the stronger and thicker bottom wall 70, thus eliminating the need for a separate bearing plate.

It should be understood that the thicker bottom wall 70 shown in FIG. 19 may also be incorporated into the embodiment shown in FIG. 18.

In the embodiment shown in FIG. 9, the bearing plate 46 is seen to be operably associated with the end portion of the truss via the hanger 64 to transfer load from the truss to the tie-rod 40.

Figure 10:
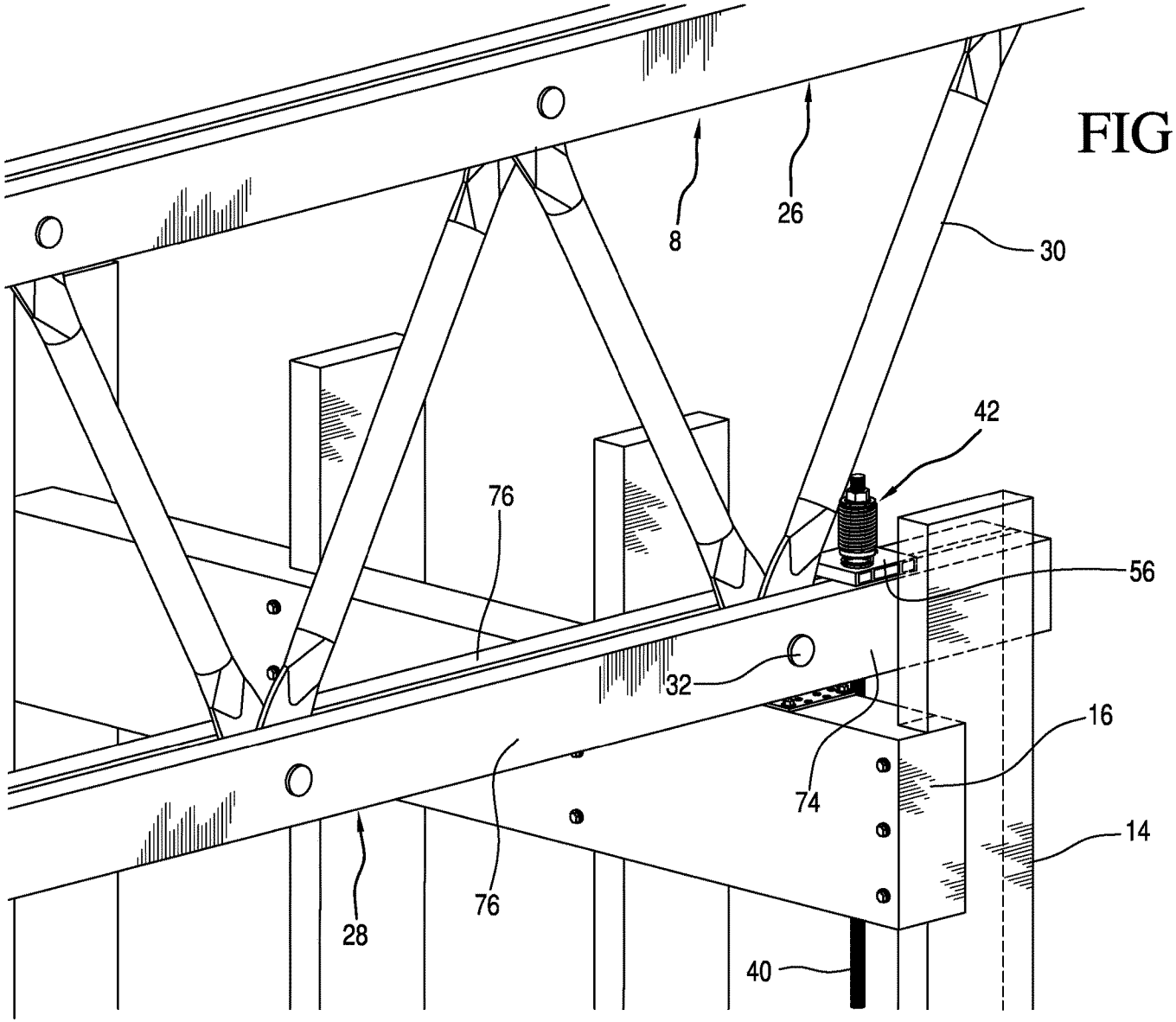
FIGS. 10-12 are enlarged perspective views of the connection of the roof truss to the wall, showing the lower chord of the roof truss being supported on a ledger attached to the wall structure.

Referring to FIG. 10, an alternative way of attaching the roof truss 8 to the ledger 16 is disclosed. Instead of the top chord 26 being attached directly to the ledger 16, the bottom chord 28 is attached. The end portion of the tie-rod 40 extends through the end portion 74 of the bottom chord 28 between the members 76. A hollow metal bearing plate 56 is disclosed, but a solid metal plate 46 may be also be used. The ledger 16 is shown recessed into the studs 14, but a butt joint may also be used.

Figure 11:
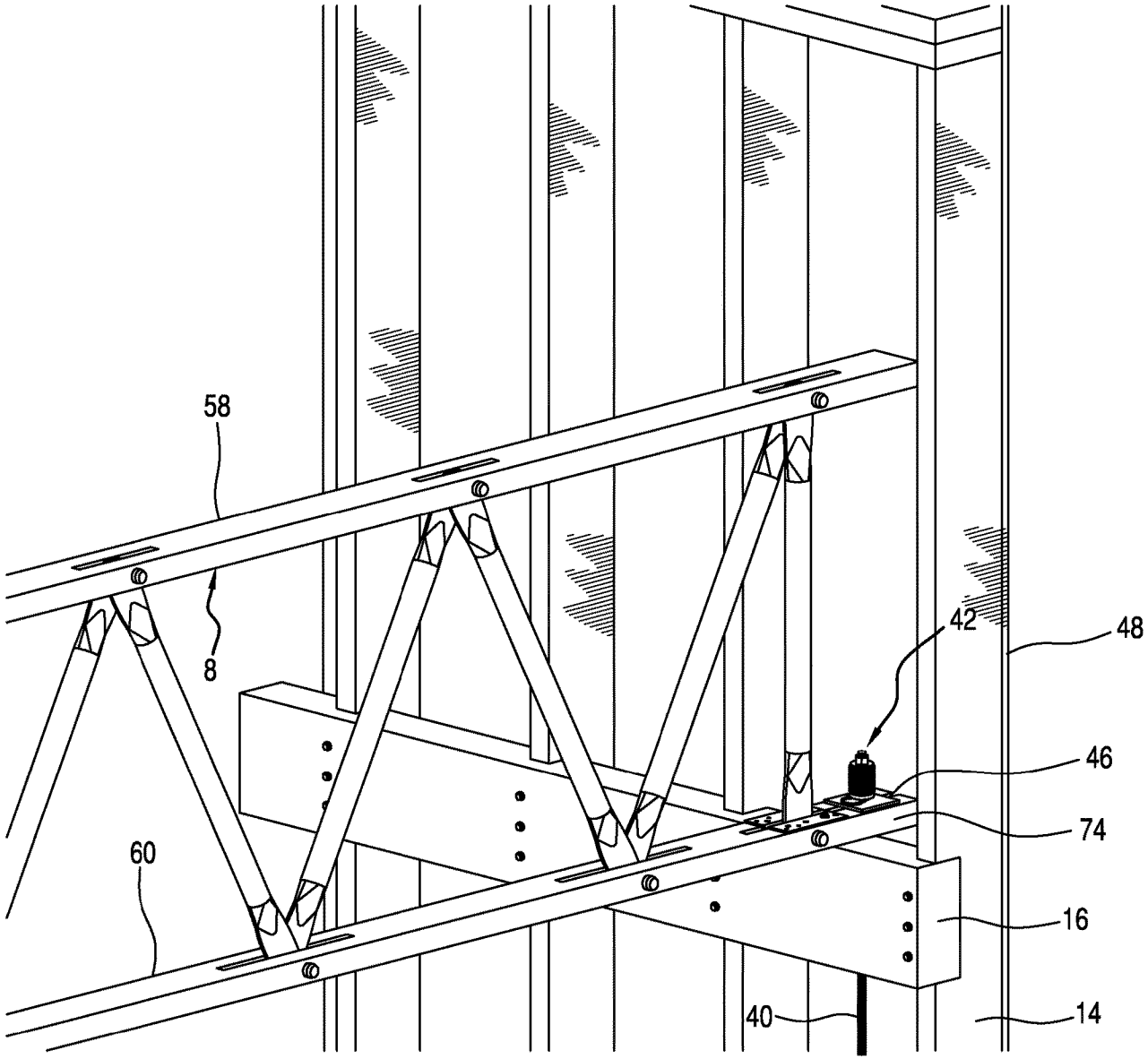

FIG. 11 is similar to FIG. 10, except that the roof truss 8 shown is of the type having a single-member top chord 58 and a single-member bottom chord 60. The end portion of the tie-rod extends through an opening through the end portion 74 of the roof truss and secured with the fastener 42 using a solid metal bearing plate 46 or a hollow metal bearing plate 56.

Figure 12:
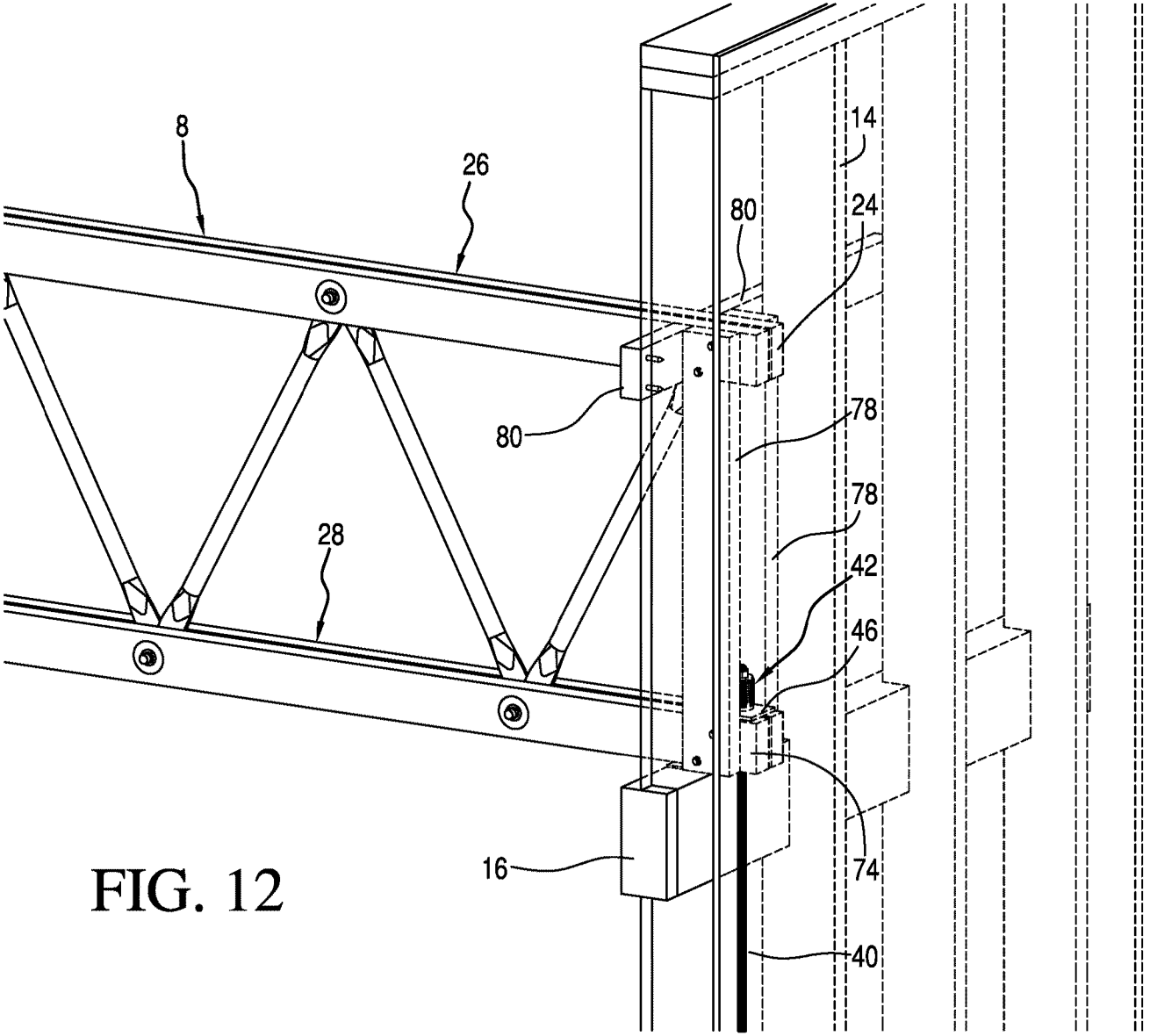

Referring to FIG. 12, stiffeners 78 are used to provide additional rigidity and load bearing capacity to the end portion of the top chord 26. The stiffeners 78 are nailed, bolted or screwed to the opposite vertical faces of the end portion 24 and 74 of the respective top chord 26 and the bottom chord 26. For lateral support of the top chord 26, blockings 80 are nailed to the studs 14 on either side of the end portion 24 to support the truss 8 in the vertical position.

Figure 13:
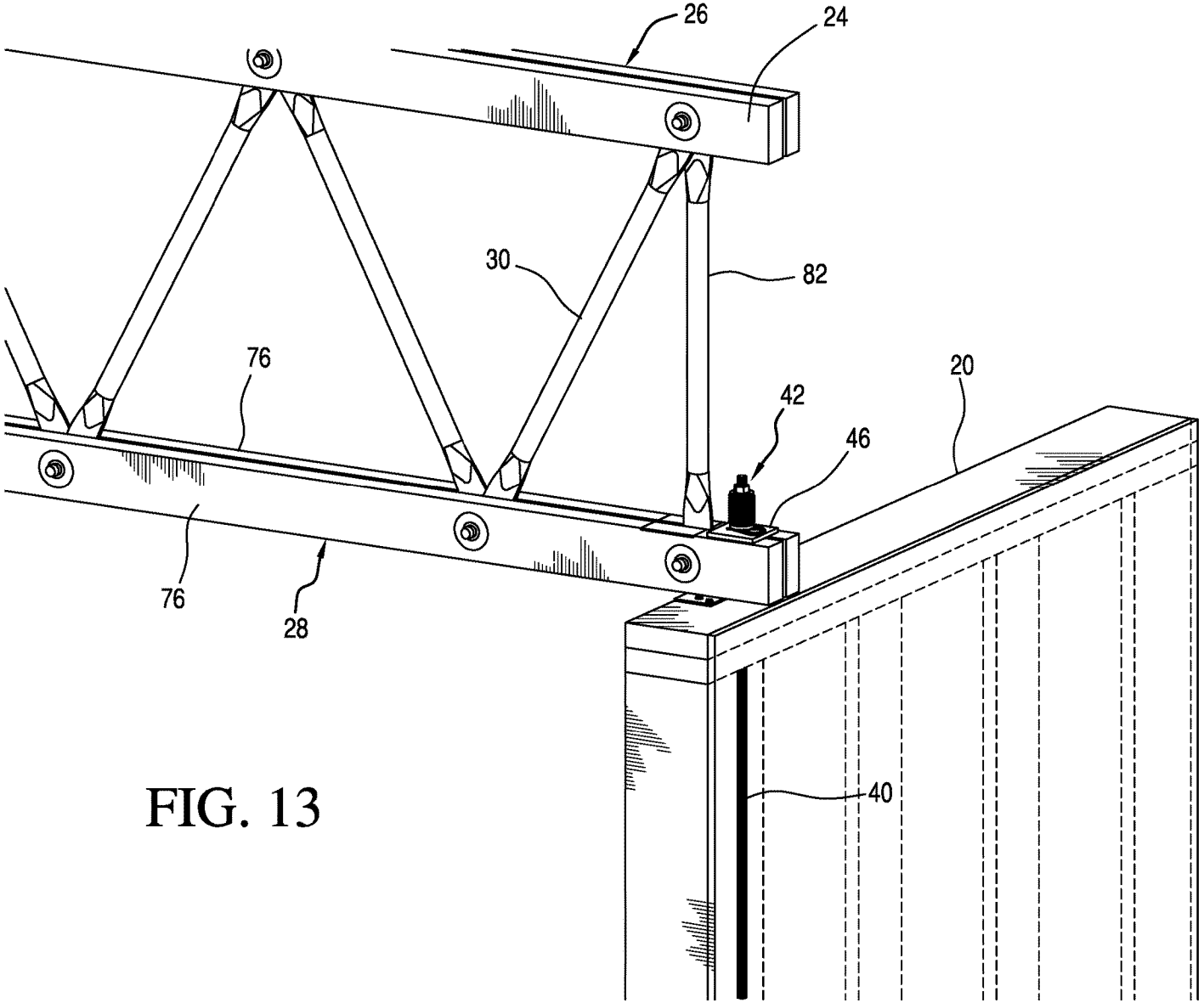
FIG. 13 is an enlarged perspective view of the connection of the roof truss to the wall, showing the lower chord of the roof truss being supported on a top plate of the wall structure.

Referring to FIG. 13, the end portion 74 of the bottom chord 28 is attached to the top plate 20 with the fastener 42. A vertical web 82 provides greater load bearing capacity for the end portion 24 of the top chord 26. The end portion of the tie-rod 40 extends through an opening in the plate 20 and through another opening between the members 76 before being attached to the fastener 42.

Figure 14:
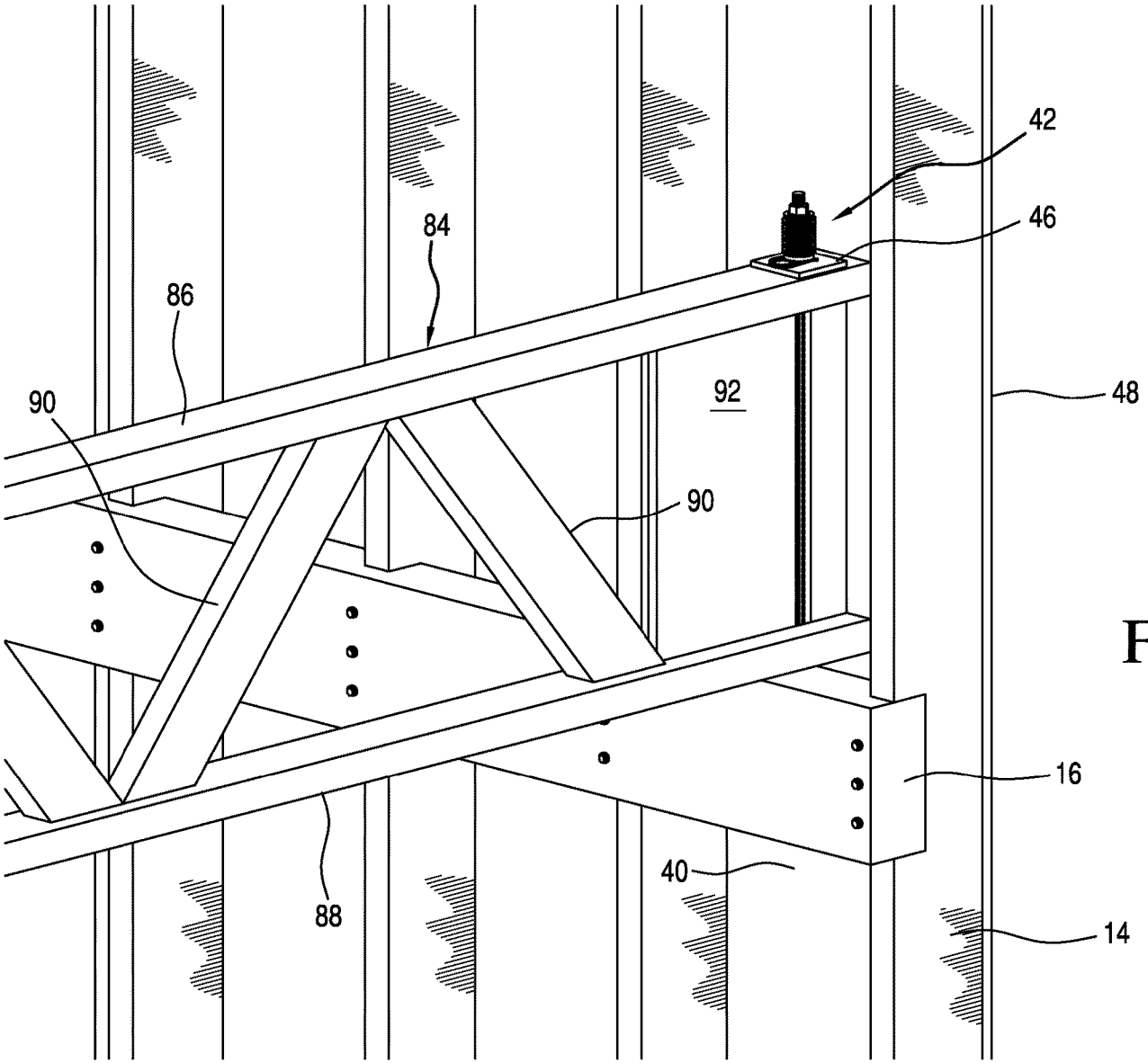
FIG. 14 an enlarged perspective view of the connection of the roof truss to the wall, showing the lower chord of another type of roof truss being supported on a ledger attached to the wall structure.

It should be understood that the roof truss disclosed herein is not limited to the pin-connected type. For example, referring to FIG. 14, a different roof truss 84 is disclosed with a top chord 86, a bottom chord 88 and webs 90 fixedly secured to the chords 86 and 88. A stiffener board 92 provides additional load bearing capacity to the end portion of the truss 84.

Figure 15:
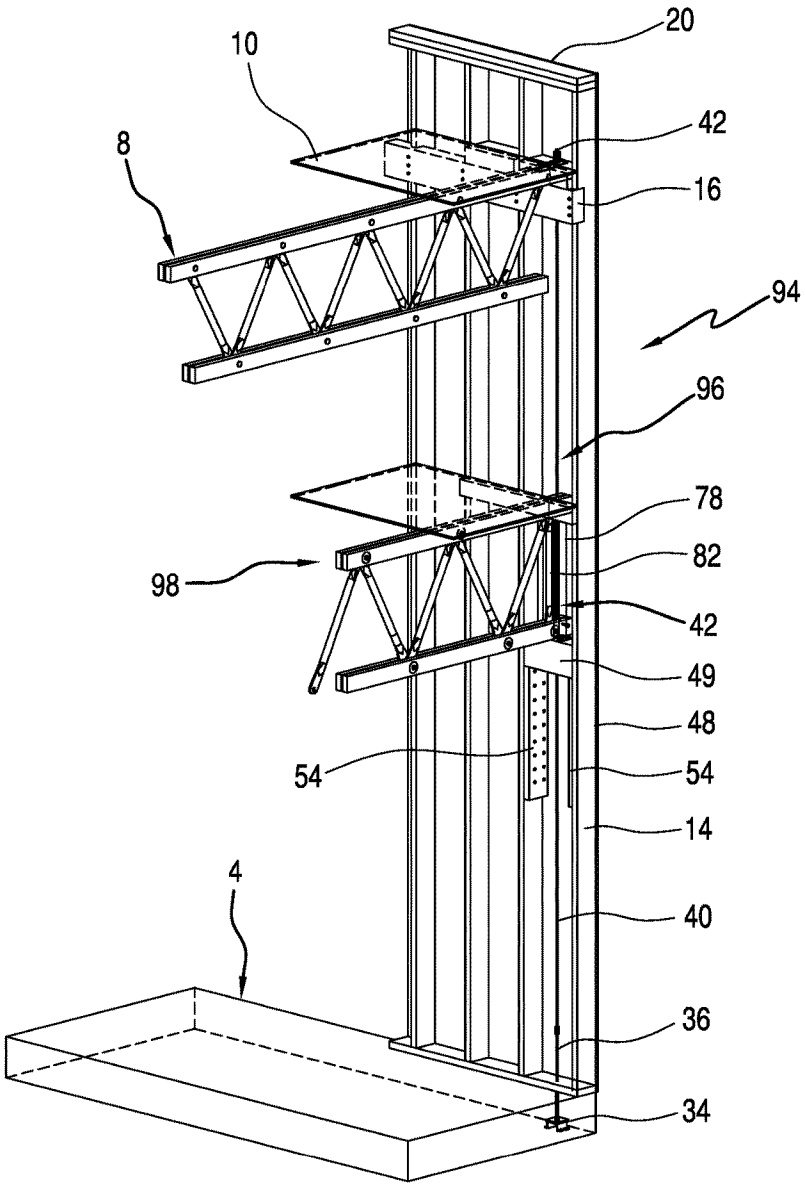
FIG. 15 is a perspective of a portion of a building structure, showing multiple floors and the roof truss being connected directly to the foundation with a tie-rod attached to the roof truss and extending through an opening through the structure of the floor joist.

The building structure and the hold down assembly 18 disclosed herein may also be applied to a multi-story building. For example, referring to FIG. 15, a two-story structure 94 is disclosed wherein a hold down assembly 94 is used, comprising a concrete anchor 34 connected to an anchor rod 36, which in turn is connected to a tie-rod 40 that extends through an opening in an end portion of a first floor joist 98 and through another opening in the end portion of the roof truss 8. An end portion of the tie-rod 40 is fastened to the truss 8 with a fastener 42.

Figure 16:
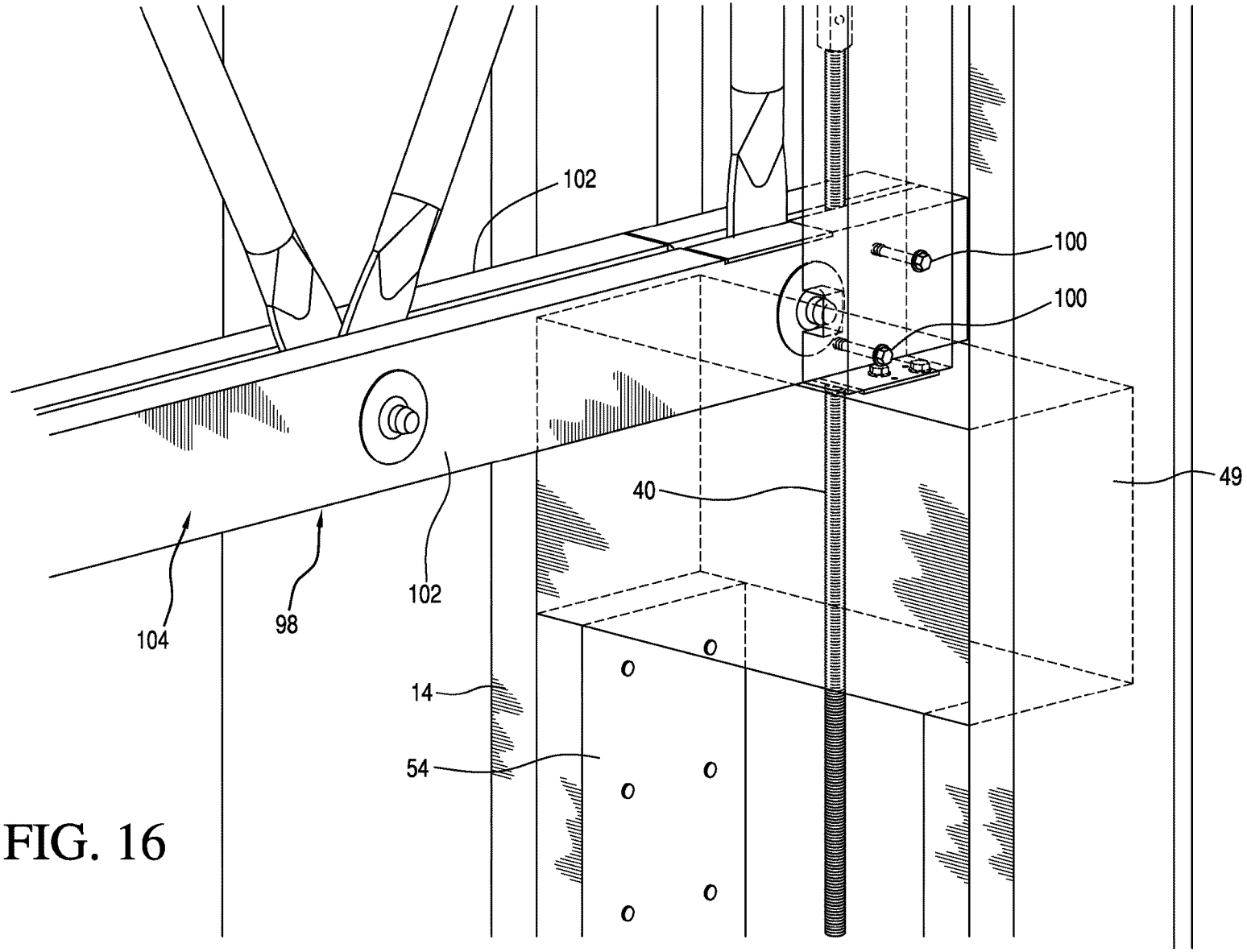
FIG. 16 is an enlarged perspective view of a portion of a multi-story building structure, showing a detail of the tie-rod extending through the floor joist structure.

The floor joist 98 is secured to the wall structure 6 using the same methods to attach the roof truss 8, as already disclosed herein. For example, referring to FIG. 15, another fastener 42 and bearing plate 46 secure an intermediate portion of the tie-rod 40 to the end portion of floor joist 98, configured in the same manner as for example shown in FIG. 11. The tie-rod 40 extends through the end portions of the floor joist 98, as shown in FIG. 16. The floor joist 98 is disclosed as a pin connected truss, but it should be understood that other types of engineered floor joists, such as the roof truss 86 shown in FIG. 14, would be just as applicable. The detail of connection of the floor joist 98 at the wall is similar to the structure disclosed in FIG. 12, showing the use of stiffeners 78 in FIG. 13, or showing a vertical web 82 in FIG. 13. The fastener 42, attaching the tie-rod 40 to the floor joist 98, may be replaced with bolts 100 to clamp the tie-rod 40 between the members 102 of the lower chord 104, as shown in FIG. 16.

In the embodiments disclosed above, the fastener 42 used in the hold down assembly 18 automatically expands axially and resists compression to take up any slack in the tie-rod 40 as the wall shrinks over time due to drying, settlement, etc. Examples of the fastener 42 are disclosed in U.S. Pat. Nos. 6,161,350 and 7,762,030, herein incorporated by reference. Other types of expanding fasteners may be used, such as disclosed in U.S. Pat. No. 6,390,747. In its basic form, the fastener 42 includes a compressed spring held between a nut and the bearing plate that urges the tie-rod under tension.

It should be understood that a nut 106, as shown in FIG. 17, may also be used to replace the fastener 42 used in all the embodiments shown above. In this installation, although the slack compensating feature of the fastener 42 is not available, the roof truss 8 and the wall structure 6 nonetheless remain directly connected to the foundation through the tie-rod 40 for effective hold down.

It should be understood that the present invention has been described in the context of roof trusses, it equally applicable to securing floor trusses to the foundation.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. A building, comprising:

a) a foundation;

b) a wall supported by the foundation;

c) a roof truss supported by the wall;

d) a hold down assembly connecting the roof truss directly to the foundation;

e) the hold down assembly comprising an anchor; a tie-rod connected to the anchor; a hanger having opposed side walls and a bottom wall directly attached to the side walls; and a fastener securing the tie-rod to the hanger;

f) the side walls are directly attached to an end portion of the roof truss wherein the end portion of the roof truss is disposed between the side walls; and g) the fastener is operably attached to the tie-rod extending between the side walls through an opening in the bottom wall, thereby tying the roof truss directly to the foundation.

2. A building as in claim 1, wherein:

a) the hanger includes a top wall attached to the side walls; and b) the top wall is supported on a top surface of the end portion of the roof truss.

3. A building as in claim 1, wherein the fastener is an expanding fastener adapted to take up slack that develops in the tie-rod.

4. A building as in claim 3, wherein the expanding fastener includes a spring under compression disposed between the bottom wall and a nut.

5. A building as in claim 1, wherein the fastener includes a nut operably pressing on the bottom wall.

6. A building as in claim 1, and further comprising a bearing plate supported by the bottom wall and the tie rod extends through an opening in the bearing plate.

7. A building, comprising:

a) a foundation;

b) a wall supported by the foundation;

c) a roof truss supported by the wall;

d) a hold down assembly connecting the roof truss directly to the foundation;

e) e) the hold down assembly comprising an anchor; a tie-rod connected to the anchor; a hanger having opposed side walls and a bottom wall attached between the side walls; and a fastener securing the tie-rod to the hanger;

f) the side walls are operably attached to an end portion of the roof truss wherein the end portion is disposed between the side walls;

g) the fastener is operably attached to the tie-rod extending between the side walls through an opening in the bottom wall, thereby tying the roof truss directly to the foundation;

h) the hanger includes a top wall attached to the side walls; and i) the top wall is supported on a top surface of the end portion of the roof truss.

8. A building, comprising:

a) a foundation;

b) a wall supported by the foundation;

c) a roof truss supported by the wall;

d) a hold down assembly connecting the roof truss directly to the foundation;

e) the hold down assembly comprising an anchor; a tie-rod connected to the anchor; a hanger having opposed side walls and a bottom wall attached between the side walls; and a fastener securing the tie-rod to the hanger;

f) the side walls are operably attached to an end portion of the roof truss wherein the end portion is disposed between the side walls;

g) the fastener is operably attached to the tie-rod extending between the side walls through an opening in the bottom wall, thereby tying the roof truss directly to the foundation; and h) a bearing plate supported by the bottom wall and the tie rod extends through an opening in the bearing plate.

* * * * *